US005662463A

United States Patent [19]

Mirzoev et al.

[11] Patent Number: 5,662,463

[45] Date of Patent: Sep. 2, 1997

[54] ROTARY SCREW COMPRESSOR HAVING A PRESSURE BEARING ARRANGEMENT

[75] Inventors: Timur B. Mirzoev; Ahmet M. Galejev; Valeriy A. Maksimov; Sergey N. Soskov; Rustam R. Ishmuratov; Alfered I. Abaidullin, all of Tatarstan, Russian Federation

[73] Assignee: Thomassen International B.V., Netherlands

[21] Appl. No.: 583,123

[22] PCT Filed: Jul. 13, 1993

[86] PCT No.: PCT/NL93/00150

§ 371 Date: Apr. 22, 1996

§ 102(e) Date: Apr. 22, 1996

[87] PCT Pub. No.: WO95/02767

PCT Pub. Date: Jan. 26, 1995

[51] Int. Cl.[6] ..... F04C 18/16; F04C 27/00; F04C 29/02

[52] U.S. Cl. ..... 418/73; 418/91; 418/201.1; 418/203

[58] Field of Search ..... 418/71, 73, 91, 418/201.1, 203

[56] References Cited

U.S. PATENT DOCUMENTS

| | | | |
|---|---|---|---|
| 3,796,526 | 3/1974 | Cawley | 418/97 |
| 3,811,805 | 5/1974 | Moody, Jr. et al. | 418/203 |
| 4,361,419 | 11/1982 | Vohringer | 418/73 |

FOREIGN PATENT DOCUMENTS

| | | | |
|---|---|---|---|
| 2520667 | 11/1976 | Germany . | |
| 59-168290 | 9/1984 | Japan . | |
| 2014504 | 6/1994 | Russian Federation | 418/203 |
| 922317 | 4/1982 | U.S.S.R. . | |

OTHER PUBLICATIONS

Extract of Derwent Publications Ltd. for SU Appln. No. 88–145865, Patent No. 1,346,853.

*Primary Examiner*—John J. Vrablik

*Attorney, Agent, or Firm*—Michael D. Bednarek; Kilpatrick Stockton LLP

[57] ABSTRACT

A rotary screw compressor that includes a male rotor and a female rotor cooperating together within a casing. The casing has a discharge outlet connected to an outlet port at a high pressure end of the working space and a suction inlet at the low pressure end of a working space. The rotor is rotatably supported at one end thereof through a bearing arrangement that includes a bracket fixed to an end cover. The bearing bracket projects into an axial cavity provided in the rotor to form a first chamber between the bracket and the rotor. The bracket is provided with an oil feed channel to feed oil into the first chamber. The rotor is rotatably supported at the low pressure end thereof through the bearing arrangement. The corresponding bearing bracket is mounted at the low pressure end of the working space and the outer circumferential surface thereof is provided with at least a groove connected to the oil feed channel and a recess connected to an oil drainage channel provided in the bearing bracket. A seal is provided between the first chamber and the working space of the compressor.

13 Claims, 8 Drawing Sheets

ROTARY SCREW COMPRESSOR HAVING A PRESSURE BEARING ARRANGEMENT

Figure 1:
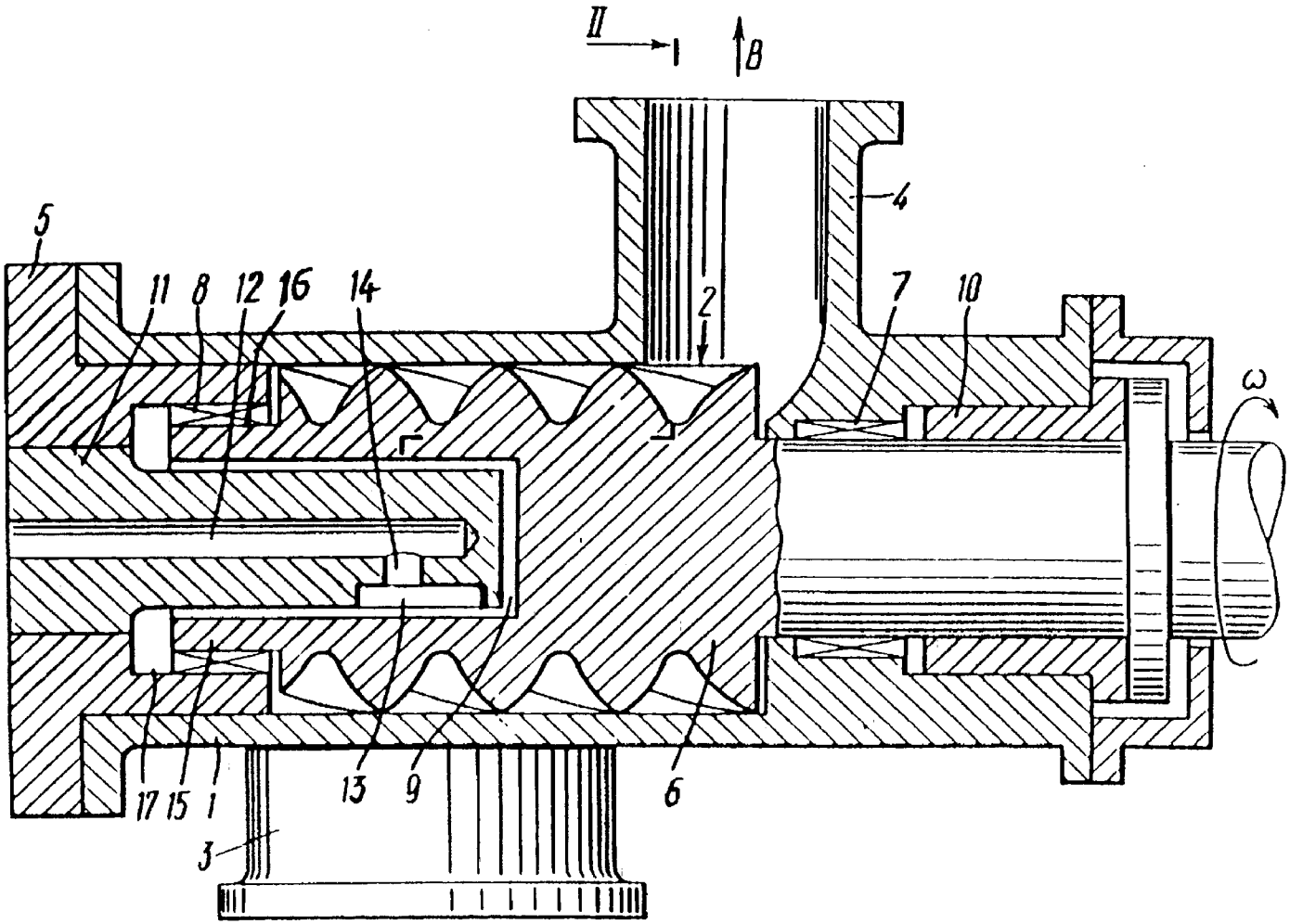

This application is a Rule 371 continuation of PCT/NL 93/00150 filed Jul. 13, 1993.

The present invention relates to a rotary screw compressor comprising a casing, a male rotor and a female rotor cooperating therewith enclosed in a working space defined by the casing, the casing having a discharge outlet connected to an outlet port at the high pressure end of the working space and a suction inlet at the low pressure end of the working space, at least one rotor being rotatably supported at an end thereof through a bearing arrangement comprising a bearing bracket being fixed to an end cover and having a substantially cylindrical outer circumferential surface, the bearing bracket projecting into an axial cavity provided in the rotor forming a first chamber between the bracket and the rotor, the bracket being provided with an oil feed channel to feed oil into the first chamber.

A rotary screw compressor oft his kind for the compression of gas is known from JP-A-59-168290. During operation of a screw compressor the rotors are subjected to radial loads arising from the compression of the gas. At the high pressure end of the working space of the known compressor a cylindrical bearing bracket is provided for each rotor, each bearing bracket projecting from the end cover into an internal axial cavity provided in the high pressure end of the corresponding rotor. Pressurized oil is fed through an oil feed channel into the chamber between the bearing bracket and the rotor. The oil then leaves the chamber and enters the working space of the compressor. Finally the oil is seperated from the compressed gas and fed into the chamber again. The rotors will also be exposed to a higher pressure at their high pressure end than at their low pressure end, resulting in an axial force acting on each rotor towards the low pressure end. Therefore each rotor of the known compressor is provided with a rolling contact thrust bearing at the low pressure end.

The bearing arrangement of the known compressor has the disadvantage that it has a limited load bearing capacity, particularly in the radial direction of the rotors. Therefore the known compressor is not capable of producing a high discharge pressure or large differential pressure between the discharge outlet and suction inlet.

It is an object of the present invention to provide a rotary screw compressor according to the preamble which has an improved bearing arrangement with a high load bearing capacity in order to handle a high discharge pressure or a high differential pressure.

This has according to the invention been achieved in that at least one rotor is rotatably supported at the low pressure end thereof through the bearing arrangement, the corresponding bearing bracket being mounted at the low pressure end of the working space and the outer circumferential surface thereof being provided with at least a groove connected to the oil feed channel and a recess connected to an oil drainage channel provided in the bearing bracket, and in that sealing means are provided between the first chamber and the working space of the compressor. According to the invention an uncomplicated bearing arrangement is obtained capable of supporting high radial loads. The load bearing capacities of this bearing arrangement not only arise from the hydrostatic pressure of the pressurized oil fed into the first chamber but also from hydrodynamic load bearing effects between each stationary bearing bracket and the corresponding rotor, which will rotate at a high speed. As the pressurized oil can also be present in the space of the first chamber between the end face of a bearing bracket and the bottom of the internal cavity of the rotor axial loads on the rotor can also be supported.

In a preferred embodiment the end face at the low pressure end of a rotor, the end cover, the casing, and the corresponding bearing bracket define a second chamber, the second chamber being connected to an oil feed channel. In this manner the pressure of the oil fed into this second chamber acts as a hydrostatic thrust bearing capable of supporting at least a part of the axial load on that rotor.

In another preferred embodiment the outer circumferential surface of at least one of the bearing brackets is provided with two longitudinal grooves and one recess, the recess being located on the side of the bearing bracket radially opposite the outlet port and being connected to the oil drainage channel, the longitudinal grooves being located at either side of the recess and being connected to the oil feed channel. The presence of two longitudinal grooves, each groove being connected to the oil feed channel, provides a zone in the first chamber wherein a high oil pressure is maintained for counteracting the radial load on the rotor. The location of the recess, which is connected to an oil drain channel, on the bearing bracket radially opposite the outlet port of the working space is preferred as an optimal counterbalancing of the radial load on the rotor can be obtained in this manner.

In a particularly advantageous embodiment the edges of the longitudinal grooves adjacent the recess are situated in a common plane through the axis of the bearing bracket at an equal distance from the recess, and the edges of the longitudinal grooves most distant from the recess are each situated in a plane inclined at an angle $\alpha$ to the common plane.

Preferably each recess has an approximate maximum length of 0.7 times the length of the bearing bracket. As each recess is located at the portion of the bearing bracket adjacent the end face thereof, a portion of the bearing bracket having a cylindrical cross section at the low pressure side of that recess forms a restriction between the recess and the second chamber provided at the low pressure end of the rotor. The restriction thus obtained prevents pressurized oil from flowing from the second chamber towards the recess and therefore prevents a drop in oil pressure in the second chamber.

Since the radial load on the male rotor arising from the compression of the gas is less than the radial load on the female rotor, due to the geometry of the rotors, the length of the bearing bracket of the male rotor and/or the length of the recess thereof is preferably less than the length of the bearing bracket of the female rotor and/or the recess thereof.

In another preferred embodiment a groove connected to the oil feed channel on the bearing bracket of the male rotor and a recess on the bearing bracket of the female rotor terminate at the end face of the corresponding bearing, and each recess on the bearing bracket of the male rotor and each groove on the bearing bracket of the female rotor are located spaced from the end face of the corresponding bearing bracket. Due to the geometry of the rotors the axial load on the male rotor arising from the compression of the gas is as a rule greater than the axial load on the female rotor. To compensate for this difference an additional axial force is exerted on the male rotor as the pressurized oil supplied to a longitudinal groove on the bearing bracket of the male rotor enters the space between the end face of that bearing bracket and the bottom of the internal cavity of the male rotor. The return flow of oil to the recess is obstructed and the oil pressure in this space is maintained.

For a high-speed screw compressor capable of a high pressure difference between the discharge outlet and the suction inlet it is advantageous that at least one of the rotors is provided with a ring shoulder protruding from its low pressure end, the sealing means being provided between the ring shoulder and the casing. This provides a further increase of the axial thrust load bearing capacity of the bearing arrangement according to the invention.

for a low-speed screw compressor with a relatively low pressure difference and wherein cooling is obtained by feeding oil into the working space of the compressor it is advantageous that at least one of the rotors is provided with sealing means between the rotor and the corresponding bearing bracket. The low-speed screw compressor is also preferably provided with a rolling contact bearing between at least one of the rotors and the corresponding bearing bracket.

The rotary screw compressor according to the present invention is capable of achieving considerably higher differential pressures between the discharge outlet and the suction inlet and considerably higher discharge pressures than the known compressors of this kind. Traditional screw compressors having bearings located outside the helical screw part of the rotors are known to achieve a differential pressure of up to 15–20 bar. The rotary screw compressor according to the invention can achieve high differential pressures and discharge pressures as much as 3 to 4 times higher. Therefore the inventive compressor can compete with centrifugal and piston compressors, and can be used, for example, for compression of natural gas in gas and oil fields, in gas delivery, gas filling and gas lift stations for gas and oil production, transportation, refinery and power recovery and chemical plants as well. Further advantages of the rotary screw compressor according to the invention are its simple design, reliability and long service life, in particular regarding the design of the bearing arrangements at the low pressure end, its limited weight and small dimensions.

Figure 2:
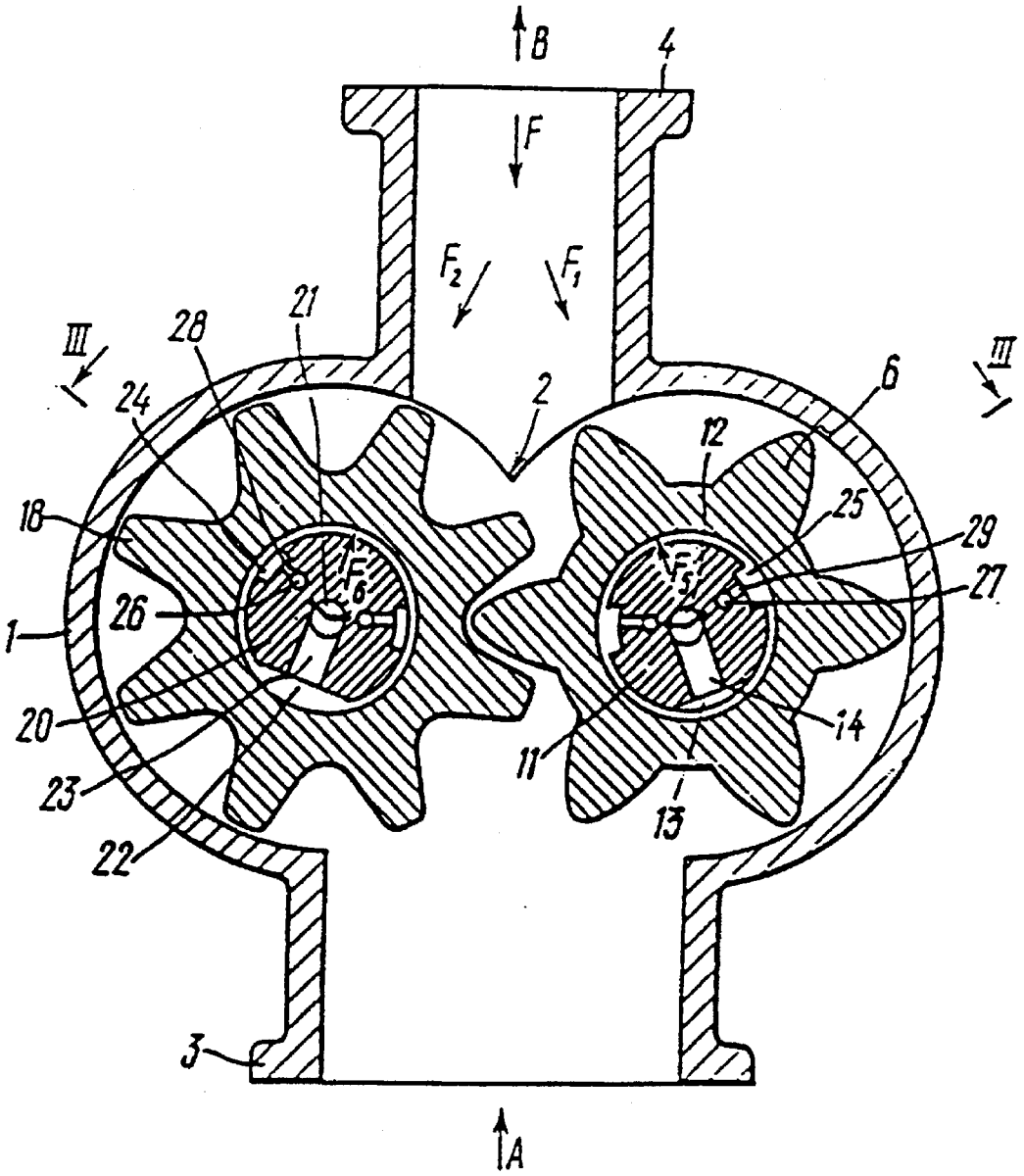
Figure 3:
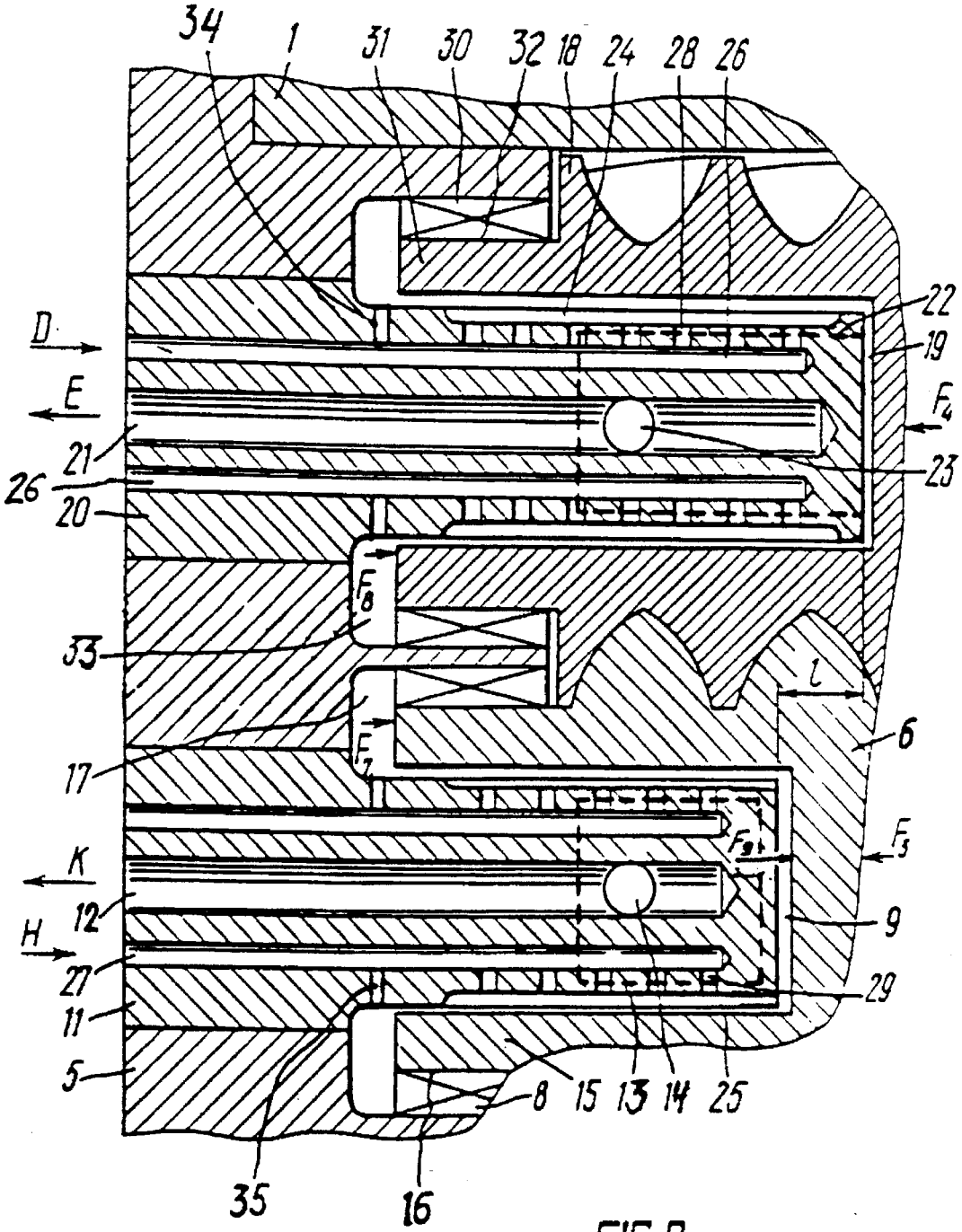
Figure 4:
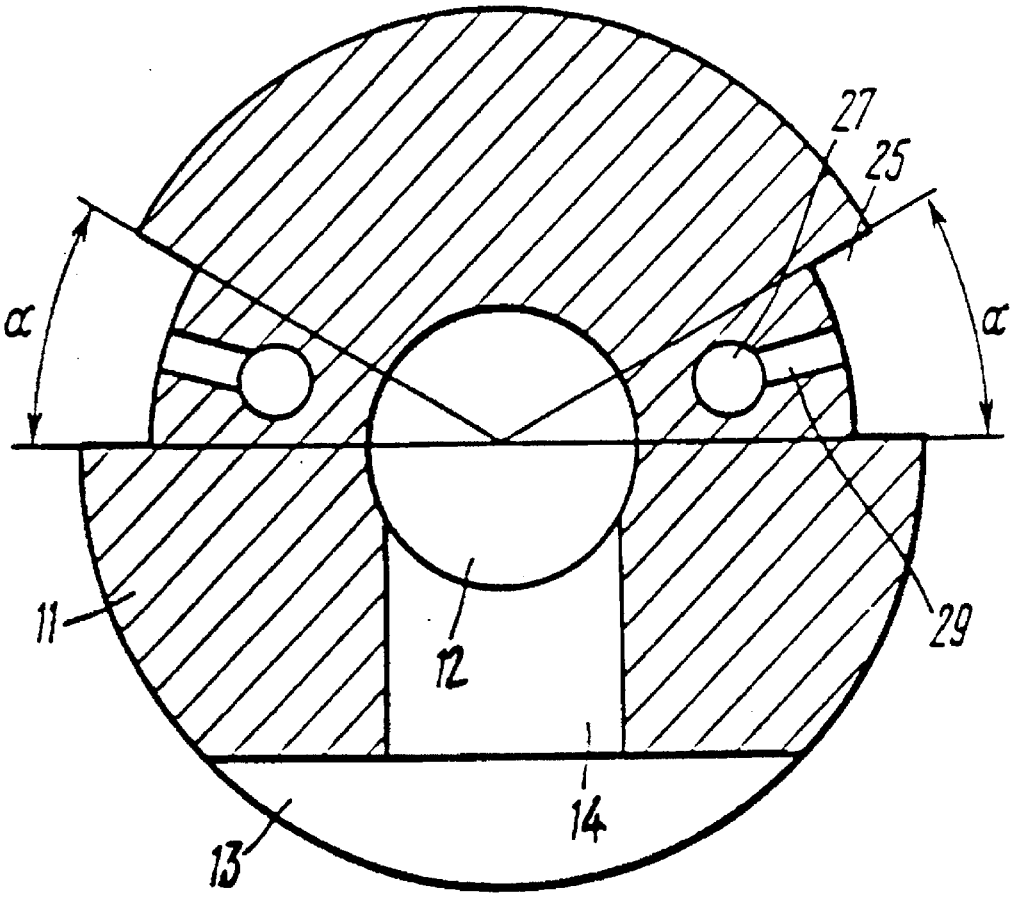
Figure 5:
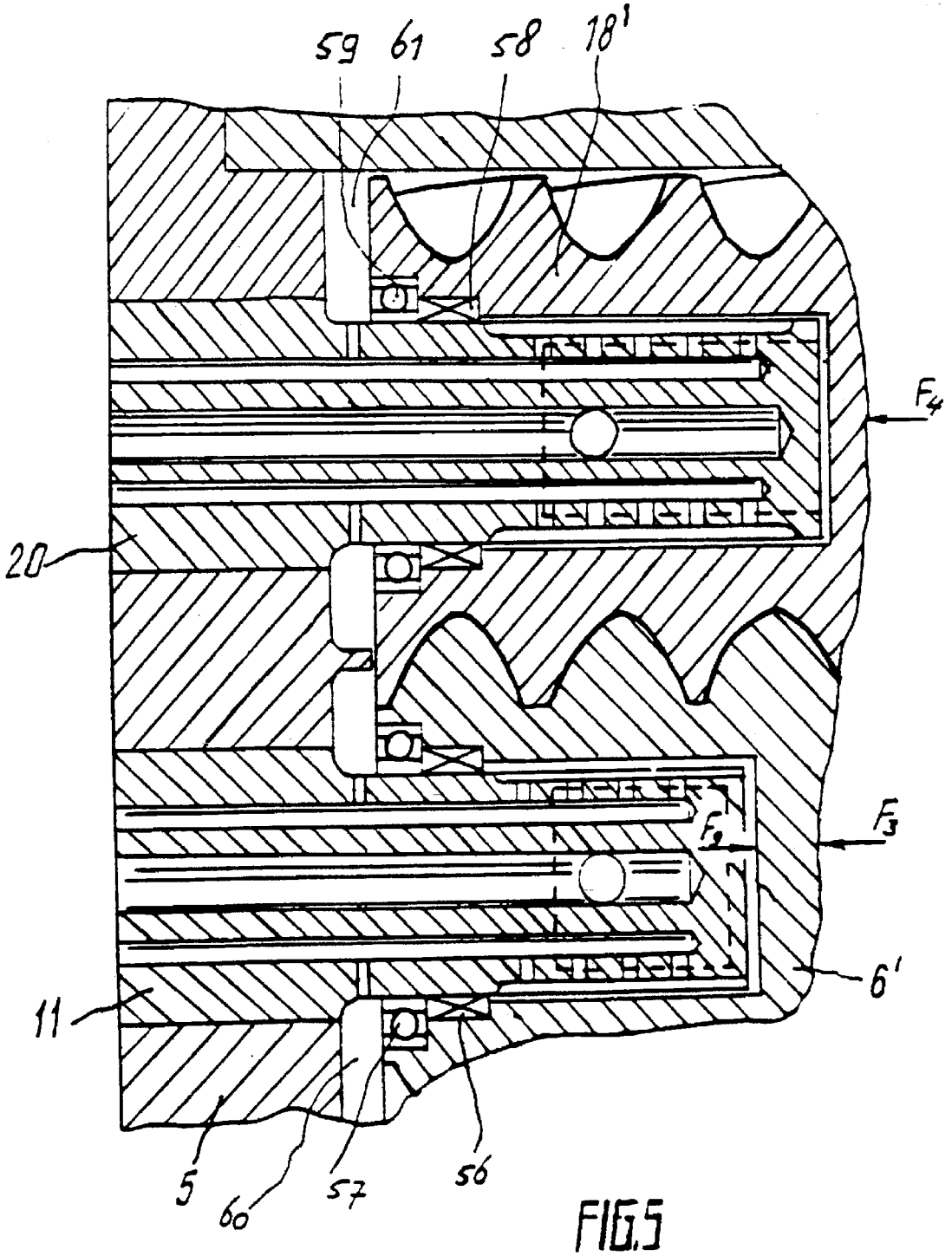
Figure 6:
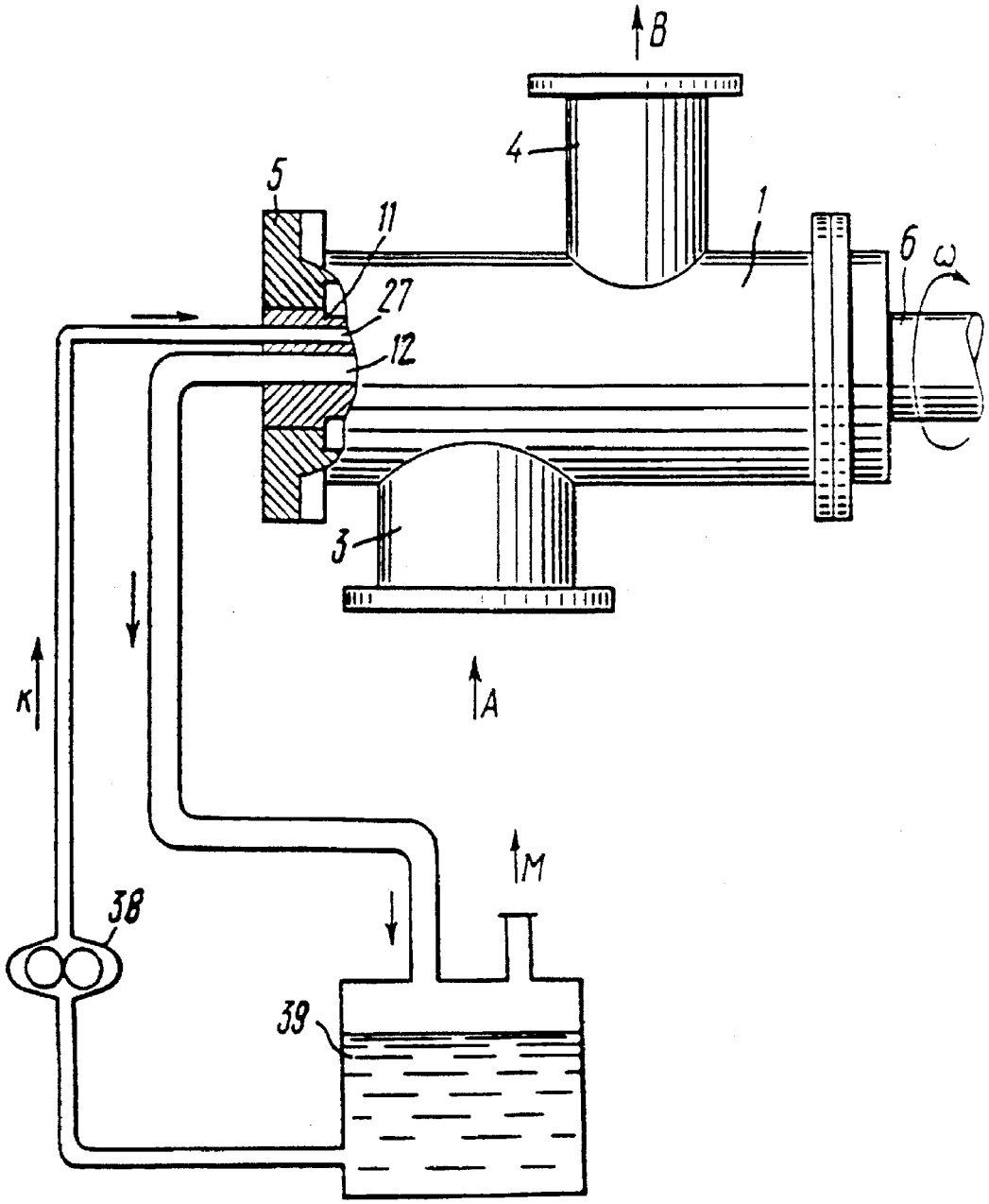
Figure 7:
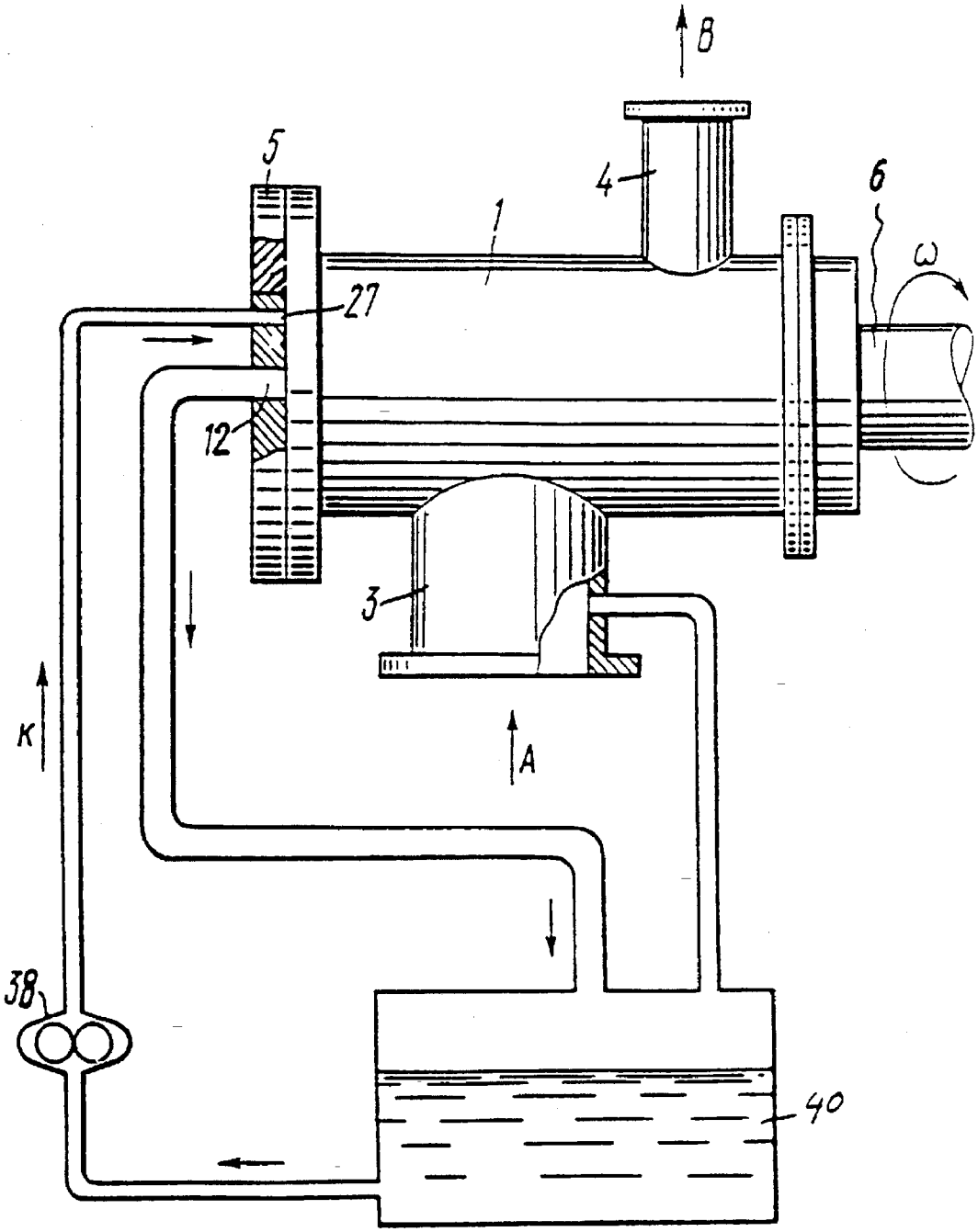
Figure 8:
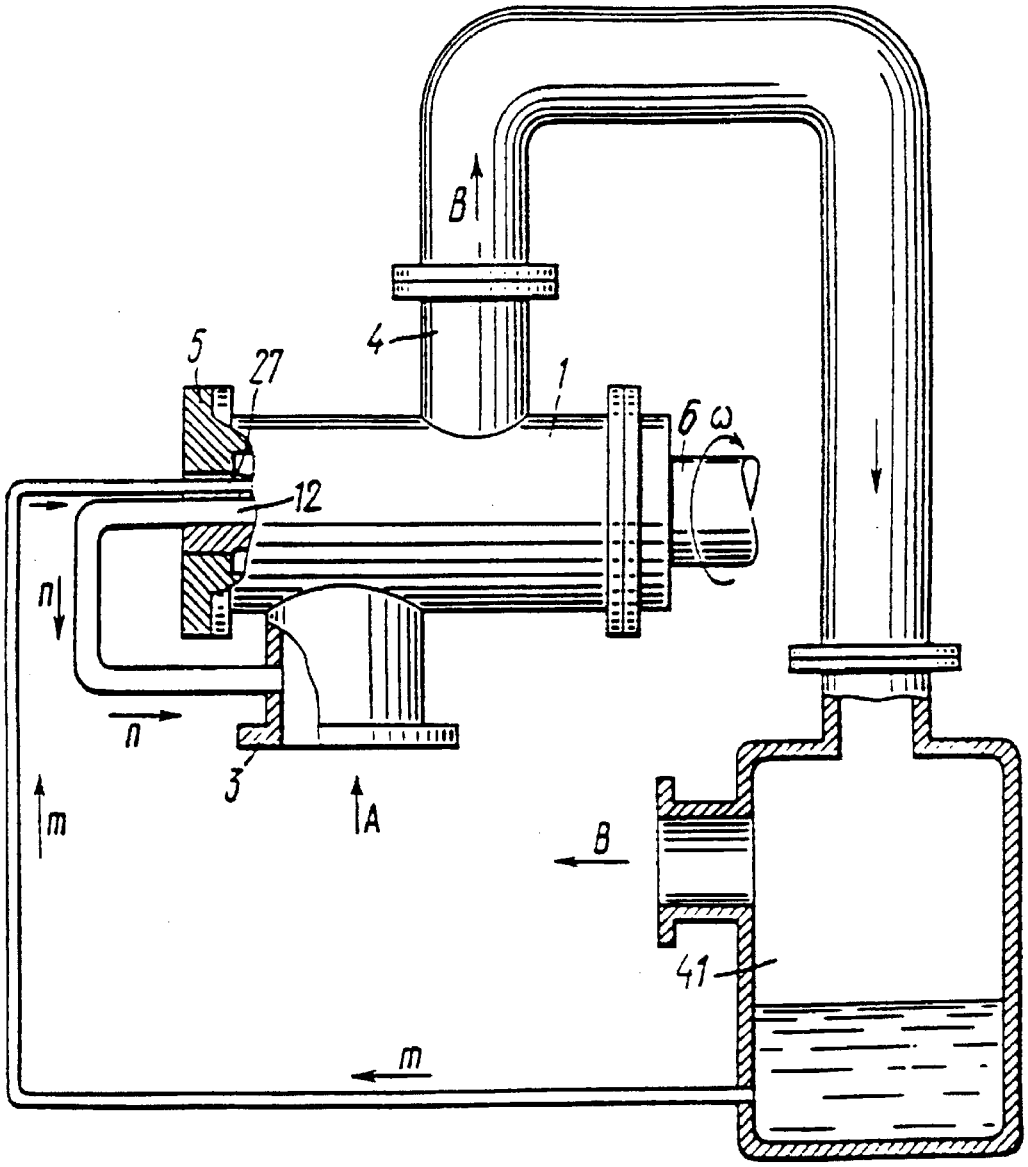

The invention will now be explained in greater detail through the following description of preferred embodiments of the screw compressor according to the invention, wherein reference is made to the accompanying drawings, in which:

FIG. 1 is a longitudinal section through the male rotor of a first embodiment of the screw compressor according to the invention, FIG. 2 is a section taken along line II—II of FIG. 1, FIG. 3 is a section taken along line III—III of FIG. 2, FIG. 4 is cross section of the bearing bracket of the male rotor of FIG. 1, FIG. 5 is a view corresponding to FIG. 2 of a second embodiment of the screw compressor according to the invention, FIG. 6 is a diagrammatic view, partly sectional, of a third embodiment of the screw compressor according to the invention, FIG. 7 is a view corresponding to FIG. 6 of a fourth embodiment of the screw compressor according to the invention, and FIG. 8 is a view corresponding to FIG. 6 of a fifth embodiment of the screw compressor according to the invention.

In FIGS. 1, 2 and 3 a rotary screw compressor is shown comprising a casing 1, a male rotor 6 and a female rotor 18 cooperating therewith enclosed in a working space defined by the casing. The casing has a outlet port 2 and a discharge pipe 4 at the high pressure end of the working space and a suction pipe 3 at the low pressure end of the working space. Arrow A indicates the direction of the gas to be compressed. Arrow B indicates the direction of the discharge of the compressed gas. Arrow ω indicates the rotation of the male rotor 6 which can be driven through drive means not shown in the drawings.

The male rotor 6 is rotatably supported through a bearing 10 at its high pressure end and a bearing bracket 11 at its low pressure end. The bearing bracket 11 is fixed on a detachable end cover 5 of the casing 1 and projects into an internal cavity in the low pressure end of the male rotor 6, thereby forming a first chamber 9 therebetween.

As can be seen in FIG. 1 the cavity and the bearing bracket 11 inside the cavity extend over a significant part of the length of the male rotor 6. Therefore the distance between the bearings 10, 11 at opposite ends of the rotor 6 is comparatively small, as a result of which the radial forces on the rotor can be better supported through the bearings and only a small radial deflection of the rotor will occur.

The low pressure end face of the male rotor 6 is provided with a protruding ring shoulder 15 having a cylindrical outer surface 16. A sealing means 7 between the male rotor 6 and the casing is provided at the high pressure end and a sealing means 8 is provided between the shoulder 15 and the casing 1 at the low pressure end.

The bearing bracket 11 has a substantially cylindrical circumferential outer surface, the surface being provided with two longitudinal grooves 25, extending parallel to the longitudinal axis of the bearing bracket, and with a recess 13. The recess 13 is an essentially rectangular cutout formed at a distance from the substantially circular end face of the bearing bracket 11 and is connected to an oil drainage channel 12 through an opening 14. As can been seen in FIG. 2 the recess 13 is located on the side of the bearing bracket 11 radially opposite the outlet port 2 for reasons explained further below. The longitudinal grooves 25 are located at either side of the recess 13 seen in circumferential direction. Each longitudinal groove 25 is connected to an oil feed channel 27 provided in the bearing bracket 11 through a number of openings 29 uniformly distributed along the length of each groove. As can be seen in FIG. 3 the longitudinal grooves 25 terminate at the end face of the bearing bracket 11 to provide communication between each groove 25 and the space formed between the end face of the bearing bracket and the bottom of the cavity in the male rotor 6.

At the low pressure end of the male rotor 6 a second chamber 17 is formed by the annular end face of the ring shoulder 15, sealing means 8, the bearing bracket 11 and the end cover 5. The chamber 17 is connected to oil feed channels 27 through openings 35.

The female rotor 18 is at its low pressure end rotatably supported in a manner similar to the male rotor 6. A bearing bracket 20 projects into an internal cavity provided in the rotor 18 forming a first chamber 19 therebetween. The bearing bracket 20 is mounted on the end cover 5. The substantially cylindrical outer surface of the bearing bracket 20 is provided with a recess 22 and two longitudinal grooves 24 located at either side of the recess 22. The recess 22 is connected to an oil drainage channel 21 through an opening 23. The recess 22 is an essentially rectangular cutout and terminates at the end face of the bearing bracket 22. The longitudinal grooves 24 are located at a distance from the end face of the bearing bracket 20 and extend towards the low pressure end. Each longitudinal groove 24 is connected to an oil feed channel 26 through a number of openings 28 uniformly disposed along the length of the groove.

The low pressure end of the female rotor 18 is provided with a protruding ring shoulder 31 having a cylindrical outer surface 32. A sealing means 30 is provided between the shoulder 31 and the end cover 5 at the low pressure end of the female rotor 18.

At the low pressure end of the female rotor 18 a second chamber 33 is formed by the annular end face of the ring shoulder 31 of the rotor, sealing means 30, the bearing bracket 20 and the end cover 5. The chamber 33 is connected to oil feed channels 26 through openings 34.

The length of the bearing bracket 11 of the male rotor 6 projecting into the male rotor is less than the length of the bearing bracket 20 of the female rotor 18 projecting into the female rotor. This is indicated by the distance "1" in FIG. 3. Also, the length of the recess 13 is less than that of recess 22, both recesses having an approximate maximum length of 0.7 times the length of the corresponding bearing bracket.

FIG. 4 shows a cross section of the bearing bracket 11 of the male rotor 6. As can be seen the recess 13 is essentially a flat portion formed on the cylindrical outer circumferential surface of the bearing bracket 11. The recess 13 communicates with the central oil drainage channel 12 through the opening 14. Each groove 25 is connected to an oil feed channel 27 through a number of openings 29 to reduce the flow resistance of the oil feed. The longitudinal grooves 25 at either side of the recess 13 are formed such that their side edges adjacent the recess 13 are located in a common first plane passing through the longitudinal axis of the bearing bracket 11 and at an equal distance from the recess 13. The other longitudinal edges of the grooves 25 are each located in a second and third plane through the axis of the bearing bracket respectively. The second and third plane each being inclined at an angle $\alpha$, preferably equal or less than 45°, to the first plane. This embodiment of the bearing bracket provides optimal conditions for a combination of hydrodynamic and hydrostatic radial load bearing capabilities and an excellent radial stiffness of the bearing arrangement. The bearing bracket 20 of the female rotor 18 has a cross section substantially similar to that of the bearing bracket 11 of the male rotor. In an alternative embodiment not shown in the drawings the location of the oil feed grooves at either side of the recess on the bearing bracket can be adapted e.g. for supporting a lower radial load on the corresponding rotor. In this case the grooves could be located closer to each other, therefore a smaller zone in the first having a high oil pressure is obtained.

A second embodiment of the compressor according to the invention is shown in FIG. 5. The compressor is provided with bearing brackets 11, 20 for the male rotor 6' and female rotor 18' respectively, the bearing brackets being similar to the bearing brackets described hereinbefore. A sealing means 56 is provided between the bearing bracket 11 and the male rotor 6'. Towards the low pressure end of the compressor a rolling contact bearing 57, such as a ball bearing, is mounted between the male rotor 6' and the bearing bracket 11. A sealing means 58 is provided between the bearing bracket 20 and the female rotor 18'. Towards the low pressure end of the compressor a rolling contact bearing 59, such as a ball bearing, is mounted between the female rotor 18' and the bearing bracket 20. This embodiment is particularly advantageous for screw compressors operating with cooling oil injected into the gas to be compressed in the working space of the compressor. These screw compressors operate at low speed compared with oil-free ("dry") compressors and have small clearances between the rotor teeth, and between the rotors and the casing. Therefore rolling contact bearings in general having smaller clearances than bearing brackets are preferred. The sealing means 56, 58 can be provided in the form of a flow obstruction having a smaller clearance than the clearance between the rotor and the bearing bracket. As can be seen in FIG. 4 no sealing means are provided between the second chambers 60, 61 and the working space.

In the embodiment shown in FIG. 6 the bearing brackets 11 and 20 of the male and female rotor respectively have their oil feed channels 26, 27 connected to a common source 38, e.g. an oil pump, for supplying pressurized oil as indicated by arrow k. The oil drainage channels 12, 21 of the respective bearing brackets 11, 20 are connected to an oil collector 39. The collector 39 is vented to the atmosphere as indicated by the arrow M. In this embodiment the source 38 is designed to supply the oil at a pressure approximately equal to the pressure of the gas to be compressed. This embodiment is preferred for screw compressors wherein the compressed gas has to be free of oil. Since the pressure in the chambers 17, 33 (FIG. 3) approximates the pressure in the suction pipe 3 the loads on the sealing means 8, 30 are limited. As the oil drainage channels 12, 21 are in open communication with the atmosphere the oil collector 39 can be of a simple design.

In the embodiment shown in FIG. 7 the bearing brackets 11 and 20 of the male and female rotor respectively have their oil feed channels 26, 27 connected to a source 38 for supplying pressurized oil as indicated by arrow k. The oil drainage channels 12, 21 of the respective bearing brackets 11, 20 are connected to an oil collector 40. The collector 40 is connected to the suction pipe 3 to maintain a pressure in the collector 40 equal to the pressure of the gas to be compressed.

In the embodiment shown in FIG. 8 the bearing brackets 11 and 20 of the male and female rotor respectively have their oil feed channels 26, 27 connected to an oil separator 41 for supplying pressurized oil as indicated by arrow m. The oil drainage channels 12, 21 of the respective bearing brackets 11, 20 are connected to the suction pipe 3 of the compressor as indicated by arrow n. The oil will then pass through the compressor along with the gas to be compressed resulting in a cooling of the gas during compression. The discharge pipe 4 of the compressor is connected to the oil seperator 41 where the oil and the compressed gas are separated. This embodiment of the compressor is preferred if the presence of oil in the compressed gas is allowed.

The rotary screw compressor according to the invention operates as follows.

The gas to be compressed enters the suction pipe 3 (FIG. 1). The male rotor 6 is rotated at a speed $\omega$ by means of an external drive acting on the male rotor 6. The gas to be compressed is entrained and compressed in chambers limited by the rotor teeth and the casing. During the compression of the gas a force F, resulting from the differential pressure between the discharge pipe 4 and the suction pipe 3, acts on the rotors as is indicated in FIG. 2. This force F is composed of radial forces $F_1$, $F_2$ and axial forces $F_3$, $F_4$ acting on the rotors 6 and 18. These forces must be supported by the bearing arrangements of the rotors.

To counteract these forces $F_1$–$F_4$ pressurized oil is fed through the oil feed channels 26, 27 (arrows D and H in FIG. 3), the openings 28, 29, and the longitudinal grooves 24, 25 of the bearing brackets 11, 20 and enters the chambers 9, 19 between each bearing bracket and the corresponding rotor. The pressurized oil is drained from chamber 9, 19 through the recess 13, 22 provided on the bearing bracket, each recess being connected to an oil drainage channel 12, 21 by an opening 14, 23 (arrows K and E in FIG. 3).

The maximum length of the recesses 13, 22, which is approximately 0.7 times the length of the corresponding bearing bracket, is preferred in this embodiment as there must be a cylindrical section of the bearing bracket having sufficient dimensions present inside the cylindrical cavity in each rotor near the low pressure end thereof to provide a restriction between the chamber 17, 33 and the recess 13, 22, respectively.

The presence of pressurized oil in the first chambers between the rotors and the bearing brackets gives rise to radial lifting forces $F_5$ and $F_6$ (FIG. 2) acting on the rotors 6, 18 respectively. The position of each recess on the bearing bracket, radially opposite the outlet port 2, as shown in FIG. 2, facilitates obtaining a balance between the forces $F_5$, $F_6$ and the forces $F_1$, $F_2$. As a result of the location of the longitudinal grooves 24, 25 a pressure zone is obtained, the pressure difference in this zone being equal to the pressure difference between the oil feed channels and the oil drainage channels.

The dimensions of the recesses 13, 22, the location and dimensions of the longitudinal grooves 24, 25, and the pressure levels in the oil feed channels as well as in the oil drainage channels depend on the desired characteristics of the rotary screw compressor. They are chosen such that the forces $F_5$ and $F_6$ compensate the major part of the forces $F_1$, $F_2$ respectively. The remaining part of each of the forces $F_1$ and $F_2$ is supported through the bearing 10 at the high pressure end of each rotor (bearing 10 of the female rotor 18 not shown in the drawings).

As a result of the geometry of the rotors defined by the toothing thereof the radial force $F_1$ is in most cases less than the radial force $F_2$. Therefore there is a difference in length between the bearing bracket 11 and/or recess 13 of the male rotor 6 and the length of the bearing bracket 20 and/or recess 22 of the female rotor 18. This is indicated in FIG. 3 by distance "1".

As a result of pressurized oil being fed into the axial chambers 17, 33 at the low pressure end of the rotors 6, 18 respectively, axial forces $F_7$, $F_8$ (FIG. 3) are exerted on the rotors opposing the axial forces $F_3$ and $F_4$ resulting from the compression of the gas. The axial forces $F_7$, $F_8$ compensate a part of the forces $F_3$ and $F_4$. The remaining part of the forces $F_3$ and $F_4$ is compensated through the bearings 10 of the rotors.

Due to the geometry of the rotors the axial force $F_3$ on the male rotor 6 is as a rule larger than the axial force $F_4$ on the female rotor 18. To compensate this difference an additional axial force $F_9$ is exerted on the male rotor 6.

According to the invention the longitudinal grooves 25 terminate at the end face of the bearing bracket to provide an open communication between the grooves 25 and the space formed between the end face of the bearing bracket 11 and the bottom of the chamber 9 of the male rotor 6. As can be seen in FIGS. 1–3 the passage of oil from this space towards the recess 13 is obstructed, whereby the oil pressure is maintained in this part of the chamber 9. This results in the axial force $F_9$, which is exerted on the rotor 6. At the same time the axial force $F_4$ on the female rotor 18 will be smaller than the force $F_3$ and since the grooves 24 on the bearing bracket 20 are not in open communication with that part of the chamber 19 no additional axial force is exerted on the female rotor. As the recess 22 terminates at the end face of the bearing bracket, the recess 22 is in open communication with the bottom part of the chamber 19, sot hat a built-up of oil pressure therein that is prevented.

The provision of bearing brackets at the low pressure ends of the rotors, which brackets project into internal essentially cylindrical cavities provided in the rotors and extend over a significant part of the length of rotors, results in a bearing arrangement having an excellent stiffness and capable of supporting high radial loads on the rotors. In combination with the comparatively small distance between the bearings at opposite ends of each rotor the deflection of the rotors resulting from the gas pressure is even further reduced. The bearing arrangement according to the invention is also capable of counteracting the axial forces on the rotors without having to provide complex additional thrust bearings.

The bearing arrangement of the rotary screw compressor according to the invention permits a considerable increase of the radial and axial forces over existing bearing arrangements, resulting in an increase of the allowable differential pressure and discharge pressure of the screw compressor.

We claim:

1. A rotary screw compressor comprising a casing defining a working space having a high pressure end and a low pressure end, a male rotor and a female rotor cooperating with the male rotor, the male and female rotors being enclosed in the working space defined by the casing, the casing having an outlet port at the high pressure end of the working space, a discharge outlet connected to the outlet port at the high pressure end of the working space and a suction inlet at the low pressure end of the working space, at least one rotor being rotatably supported at an end thereof through a bearing arrangement comprising a bearing bracket, means fixing the bearing bracket relative to the casing, the bearing bracket having a substantially cylindrical outer circumferential surface, the bearing bracket projecting into an axial cavity provided in the rotor so as to form a first chamber between the bracket and the rotor, the bracket being provided with an oil feed channel to feed oil into the first chamber, wherein at least one rotor is rotatably supported at the low pressure end thereof through the bearing arrangement, the corresponding bearing bracket being mounted at the low pressure end of the working space and having an outer circumferential surface that is provided with at least a groove connected to the oil feed changed and a recess connected to an oil drainage channel provided in the bearing bracket, and sealing means provided between the first chamber and the working space of the compressor.

2. A rotary screw compressor according to claim 1, further comprising an end cover fixed to the bearing bracket and wherein the end face at the low pressure end of a rotor, the end cover, the casing, and the corresponding bearing bracket define a second chamber, the second chamber being connected to an oil feed channel.

3. A rotary screw compressor according to claim 1, wherein the outer circumferential surface of at least one of the bearing brackets is provided with two longitudinal grooves and one recess, the recess being located on the side of the bearing bracket radially opposite the outlet port and being connected to the oil drainage channel, the longitudinal grooves being located at either side of the recess and being connected to the oil feed channel.

4. A rotary screw compressor according to claim 1, wherein the outer circumferential surface of at least one of the bearing brackets is provided with two longitudinal grooves and one recess, the recess being located on the side of the bearing bracket radially opposite the outlet port and being connected to the oil drainage channel, the longitudinal grooves being located at either side of the recess and being connected to the oil feed channel, and wherein the edges of the longitudinal grooves adjacent the recess are situated in a common plane through the axis of the bearing bracket at an equal distance from the recess, and in that the edges of the longitudinal grooves most distant from the recess are each situated in a plane inclined at an angle α to the common plane.

5. A rotary screw compressor according to claim 1, wherein each recess has a maximum length of 0.7 times the length of the bearing bracket.

6. A rotary screw compressor according to claim 1, wherein the length of the bearing bracket of the male rotor and the length of the recess thereof is less than the length of the bearing bracket of the female rotor and the recess thereof.

7. A rotary screw compressor according to claim 1, wherein a groove connected to the oil feed channel on the bearing bracket of the male rotor and a recess on the bearing bracket of the female rotor terminate at the end face of the corresponding bearing bracket, and in that each recess on the bearing bracket of the female rotor are located spaced from the end face of the corresponding bearing bracket.

8. A rotary screw compressor according to claim 1, wherein at least one of the rotors is provided with a ring shoulder protruding from its low pressure end, the sealing means being provided between the ring shoulder and the casing.

9. A rotary screw compressor according to claim 1, wherein at least one of the rotors is provided with sealing means between the rotor and the corresponding bearing bracket.

10. A rotary screw compressor according to claim 1, wherein a rolling contact bearing is provided between at least one of the rotors and the corresponding bearing bracket.

11. A rotary screw compressor according to claim 1, wherein supply means are provided to supply oil to the oil feed channels of the bearing brackets at a pressure approximately equal to the pressure of the gas to be compressed at the suction inlet, and in that the oil drainage channels of the bearing brackets are connected to an oil collector, the oil collector being connected to the supply means and being vented to the atmosphere.

12. A rotary screw compressor according to claim 1, wherein supply means are provided to supply oil to the oil feed channels of the bearing brackets at a pressure approximately equal to the pressure of the compressed gas at the discharge outlet, and in that the oil drainage channels of the bearing brackets are connected to an oil collector, the oil collector being connected to the supply means and to the suction inlet.

13. A rotary screw compressor according to claim 1, wherein the oil feed channels of the bearing brackets are connected to an oil separator, the oil separator being connected to the discharge outlet of the compressor, and in that the oil drainage channels of the bearing brackets are connected to the suction inlet.

* * * * *